US005887727A

United States Patent [19]

Ames

[11] Patent Number: 5,887,727

[45] Date of Patent: Mar. 30, 1999

[54] SMALL HARDWARE SORTING BED AND TRANSPORT DEVICE

[76] Inventor: John L. Ames, P.O. Box 6183, Bradenton, Fla. 34281

[21] Appl. No.: 812,055

[22] Filed: Mar. 8, 1997

[51] Int. Cl.[6] ..... B07B 1/04

[52] U.S. Cl. ..... 209/352; 209/355; 209/420

[58] Field of Search ..... 209/352, 353, 209/355, 399, 403, 409, 412, 413, 417, 420

[56] References Cited

U.S. PATENT DOCUMENTS

| | | | |
|---|---|---|---|
| 74,483 | 2/1868 | Barker | 209/355 |
| 1,127,774 | 2/1915 | Kelley | 209/355 |
| 2,154,599 | 4/1939 | Beckwith | 209/355 X |
| 2,183,773 | 12/1939 | Lehman | 209/352 X |
| 5,538,139 | 7/1996 | Keller | 209/353 X |

FOREIGN PATENT DOCUMENTS

| | | | |
|---|---|---|---|
| 1697903 | 12/1991 | U.S.S.R. | 209/355 |

*Primary Examiner*—Tuan N. Nguyen
*Attorney, Agent, or Firm*—Dorothy S. Morse

[57] ABSTRACT

A device for handling small objects which performs the combined functions of collection, inspection, sorting, transfer, and funneling. The device has a planar sheet of material optionally having uniformly dimensioned openings therethrough, a three-sided frame attached to the top and side edges of the sheet for support, with the top frame member and the side frame members remaining unattached to one another. Optionally hinges can be used to connect top frame member and side frame members when the sheet is required to support heavy loads. The dimension and configuration of top and side frame members are defined by the size and shape of objects to be retained on the surface of the sheet. A portion of each side frame member extends beyond the unbounded bottom edge of the sheet to form a handle. When the sheet is fully opened into a flat configuration, the device can be used for collection, inspection, and sorting. When it is partially folded it can be used to transport objects and funnel them across its unbounded bottom edge into storage containers. Although equally contemplated for individual use, when several present invention devices are used together in a stacked arrangement and each device has a different size of openings therethrough, they can collectively consolidate and sort small objects according to size. Optional crease and fold lines in the sheet can enhance its funneling efficiency.

18 Claims, 3 Drawing Sheets

SMALL HARDWARE SORTING BED AND TRANSPORT DEVICE

BACKGROUND—FIELD OF INVENTION

This invention relates to collection, inspection, and sorting devices, specifically to a collection, inspection, sorting, funneling, and transfer device for small objects, the device having a sheet of material with uniformly dimensioned openings therethrough, a three-sided frame for supporting the sheet with side frame members which extend beyond the lower edge of the sheet for use as handles, also with the top and side frame members for most purposes remaining unattached to one another during use. When necessary for the transport of heavy loads, hinges can optionally be used between the top frame member and the elongated side frame members to interconnect them. When the device is placed into a flat, horizontally oriented configuration it is contemplated for use to collect, inspect, and sort objects, its partially folded configuration being contemplated for use to both transport objects and transfer objects by funneling them into storage containers. Although it is primarily contemplated for the present invention to be used individually, it is also contemplated for several present invention devices to be used together in a stacked arrangement to consolidate and sort small objects according to size. The device of the present invention is versatile for many applications and repetitive uses, including but not limited to, use as a small hand-held device for handling and sorting small hardware objects such as screws, nuts, and washers by a person seated in front of a work bench; handling and sorting craft supplies such as beads, sequins, and shells; handling and sorting sewing supplies such as buttons, snaps, and hooks; use by pharmacists to sort and package pills and other medications; use for alignment and transfer of objects having an elongated configuration; sorting metallic objects from nonmetallic ones magnetically; assembly and packaging of small objects for construction and repair kits; holding automobile and other parts while dipping them into cleaning solutions; collecting chopped foods and transferring them into a cooking pot; catching a ball tossed by a playmate; sifting sand on a beach to retrieve small shells and shark's teeth mixed therewith; and for use in archaeology sites to sift dirt for the retrieval of bones and small pottery fragments mixed therein; as well as the use of larger present invention devices in industrial applications such as use of individual devices to feed parts into machinery, or the placement of one or more devices stacked on top of one another and the positioning of the stacked devices adjacent to, or under, a piece of machinery to catch small components used therewith or salvageable scraps resulting from machinery operation, after which the lifting of each device from the stack could be achieved mechanically by ropes, cables, and pulleys for the transfer of collected components and scraps to other locations. Due to the X,Y configuration of the uniformly dimensioned holes in the sheet of the present invention, industrial robots using an X,Y coordinate perspective for locating objects could also more easily retrieve objects from bins within which one of the present inventions was positioned for ease in sorting and transferring objects from the bin.

BACKGROUND—DESCRIPTION OF PRIOR ART

A person needing to efficiently perform the successive functions of collection, inspection, sorting, funneling, and transfer generally has been required to rely on more than one device. Funnels are known for transferring liquids, powdered materials, and small objects from one container into another. They allow such objects as pellets, pills, beads, crystals, and the like to be neatly and efficiently transferred into storage containers having narrow openings. However, funnels are inefficient for sorting objects and separating them by size. A variety of collection, inspection, sorting, funneling, and transfer devices are used by pharmacists for separating counted tablets and capsules and transferring them into bottles for patient use. Such devices usually have a flat, tray-like surface upon which the medication is placed while it is being counted, in addition to a depending portion which collects the medication and permits its funneling into bottles. However, such devices are contemplated for sorting and separating similarly sized doses of medication and they do not have uniformly dimensioned openings therethrough for the separation of objects, debris, or scraps from a variety of unwanted materials. Sieves are known for separating and sorting small objects according to the size of the openings in their screens, retaining upon the upper surfaces of their screens only objects larger than the dimension of the openings therein, while letting smaller objects pass through the screen for possible sorting by a series of other sieves positioned below. However, once objects are collected and sorted into the sieves, it is not always easy to transfer the collected objects out of them. Therefore it would be useful, and it is not known, to have an easy-to-use, multi-function device which efficiently performs all of the functions of collection, inspection, sorting, and transfer of small objects from one location to another, a device having a three-sided frame supporting a sheet of material having a plurality of uniformly sized openings therethrough, the sheet being shorter in length than the elongated side frame members so that the unattached portion of each of the elongated side frame members can be used as a handle; and with the top and side frame members for most purposes remaining unattached to one another during use so that the sheet may be temporarily placed into its partially folded configuration for use in funneling small objects supported thereupon into a storage container.

SUMMARY OF INVENTION—OBJECTS AND ADVANTAGES

It is the primary object of this invention to provide a time-saving device which can be manufactured in a variety of sizes for use in repetitive applications to perform the combination of functions which includes sorting, inspection, collecting, transferring, and transport of small objects. It is also an object of this invention to provide a hand-held collection device which can be used to sort small objects on a work surface, such as by people seated in front of a work bench, seamstresses, and those performing beadwork or other crafts involving the use of small objects, and thereafter used to efficiently transfer the sorted objects into one or more containers for storage. It is also an object of this invention to provide a hand-held collection and transfer device for use in industrial applications such as aligning elongated objects and feeding them into machinery. A further object of this invention is to provide a large collection device which can be positioned adjacent to an industrial work area to collect debris and other small objects dropped from counters and machinery, and which thereafter could be used to sort the collected debris and objects by size as well as funneling them into storage containers. It is also an object of this invention to provide a collection device which is light in weight and easy to handle. A further object of this invention is to provide a collection device which is made from materials that are wear-resistant, chemically inert, and otherwise structured for the intended use. It is also an object of this invention to provide a collection device having uniformly sized openings therethrough which can function individually, or collectively with others, as a separating device to sort objects by size. It is a further object of this invention to provide a collection device which has a sheet that can be magnetized for use in separating objects, such as separating a mixture of metal filings and brass objects, whereby when the device is inclined the metal filings would stick to the top surface of the collection device sheet while the brass objects would move across the sheet's unbounded edge and drop from the sheet's surface into a storage container.

As described herein, properly manufactured and used, the present invention would provide a planar sheet upon which small objects could be collected and sorted. For many uses the sheet would be made from flexible material, such as a plastic. As an alternative, the sheet could be made from a rigid material and provide fold lines to allow placement into a partially folded configuration for small object transfer. A three-sided frame comprising a top frame member and two elongated side frame members each attached to the sheet, but not to one another, would prevent small objects from easily rolling or dropping off of the sheet's top and side edges. When the present invention is in its fully opened and flat configuration, a user could sort and inspect a variety of small objects placed upon the sheet. As a user sorts through small objects on top of the sheet, the user could repeatedly look through the small objects, then fold and quickly unfold the present invention to redistribute the small objects for additional sorting once it is again placed into its fully opened and flat configuration. Although primarily contemplated for individual use, several present invention devices could simultaneously be used to sort different objects at once, the stacked configuration conserving work bench space between uses. For example, a user could place an assortment of bolts on the sheet of a first present invention device to look for a bolt of a particular size. When the needed bolt is found, the user could temporarily place the first present invention device holding the bolts on the surface of a work bench. The user could then employ a second present invention device to sort nuts to find one correctly sized for use with the chosen bolt. The second present invention device could be set down on top of the first device without mixing or losing any of the nuts or bolts on either of the sheets as the three-sided frames of both the first and second devices would hold the nuts and bolts between the side and top edges of each respective sheet, while the user picks up a third present invention device to sort screws. By temporarily stacking each present invention device upon a previously used device, work bench space is maximized. Also, the present invention could be placed on top of clutter on a workbench to sort objects since the three-sided frame would define a boundary within which the objects would be retained, even if the surface of the clutter was not entirely horizontal. Such a convenience would save a user time since the user would not have to clear an area on the work bench for its use. After finding the bolts, nuts, and screws needed for use, the sheet of each present invention device would be partially folded and the tree-sided frame tipped toward the unbounded edge of the sheet that is centrally positioned between the side frame members for easy, one-handed, and efficient movement of the small objects contained upon the surface of the sheet across its unencumbered bottom edge and into a storage container. The side frame members could have varying cross-sectional configurations, such as that of a circle or an I-beam. The side frame members could also be configured to be approximately parallel to one another, or the side frame members could be arcuate at least in part so that the present invention device can be placed adjacent to a curved surface during use as a collection device. An example of a collection device use is as a ball catcher, with the handle portions of the side frame members being crossed over one another to hold a ball indefinitely against the surface of the folded sheet. The sheet would comprise material having a plurality of uniformly dimensioned openings therethrough and would be attached between the elongated side frame members and a top frame member. The elongated side frame members and the top frame member would provide a raised edge as a means of stopping small objects from moving across the top and side edges of the sheet. The top frame member would not be rigidly fixed to the elongated side frame members. However, to allow the present invention device to support heavier loads, hinges could be used for pivotal connection between the ends of the top frame member and each elongated side frame member. The length dimension of the sheet would be smaller than the length of the elongated side frame members so that an unattached portion on one of the ends of each elongated side frame member can be used as a handle. During use, after the sheet has collected objects on its upper surface, the handle portions of the elongated side frame members would be moved toward one another to partially fold the sheet into a narrowed, tapered configuration that would securely hold the collected objects upon the sheet's upper surface during transport. Then when the sheet is positioned over an intended storage container and placed at an oblique angle relative to the upper opening of the storage container so that the unbounded bottom edge of the sheet is adjacent to the storage container, the collected objects would move across the sheet's partially folded upper surface and be orderly funneled across its unbounded bottom edge into the storage container. When several present invention devices are used together in a stacked arrangement, and each device has a different size of openings therethrough, the devices collectively can be used to consolidate and sort the small objects according to size, with each device being separately lifted from the stack for efficient transfer of the objects it collected into a storage container. Applications may include, but are not limited to, use at a work bench for handling and sorting small hardware objects such as screws, nuts, and washers; handling and sorting craft supplies such as beads, sequins, and shells; handling and sorting sewing supplies such as buttons, snaps, and hooks; use by pharmacists to sort and package pills and other medications; use for alignment and transfer of objects having an elongated configuration, sorting metallic objects from non-metallic ones magnetically; assembly and packaging of small objects for construction and repair kits; holding automobile and other parts while dipping them into cleaning solutions; collecting chopped foods and transferring them into a cooking pot; catching a ball tossed by a playmate; sifting sand on a beach to retrieve small shells and shark's teeth mixed therewith; and for use in archaeology sites to sift dirt for the retrieval of bones and small pottery fragments mixed therein; as well as the use of larger present invention devices in industrial applications such as aligning and feeding parts into machinery and in placement of one or more present invention devices on top of one another, each having a different sizes of openings therethrough, in a stacked arrangement adjacent to a piece of machinery to catch small components used therewith or salvageable scraps produced as a result of machinery operation, after which each of the present invention devices is independently lifted mechanically by ropes, cables, and pulleys for transfer of the collected components or scraps to remote locations.

The description herein provides preferred embodiments of the present invention but should not be construed as limiting the scope of the collection, inspection, sorting, funneling, and transfer device invention. For example, variations in the surface area and thickness dimension of the sheet, the mesh size of the material comprising the sheet, the type of material from which the sheet is made, the length and cross-sectional dimension of the elongated side frame members, the materials from which the elongated side frame members are made, the type of hinges used between the top frame member and the elongated side frame members, the type of support hook or ring attached to the top frame member, the configuration and dimension of handles used, and the type of connecting means attached to the ends of the elongated side frame members for use in mechanically moving larger embodiments of the device, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
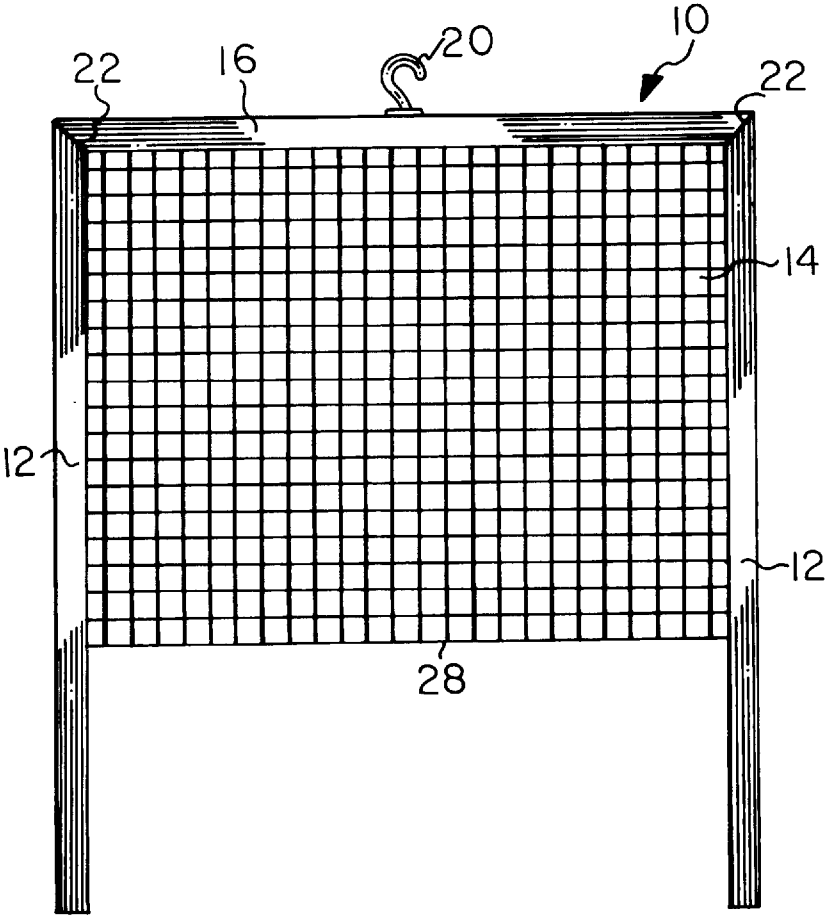
FIG. 1 is a top view of the invention positioned with its sheet open for the collection, sorting, and inspection of small objects.

FIG. 1 shows a preferred embodiment of a collection, inspection, sorting, funneling, and transfer device 10 having a sheet of material 14 connected between two spaced-apart elongated side frame members 12. FIG. 1 shows elongated side frame members 12 having a circular cross-section and being approximately parallel to one another in a fully opened and flat configuration. However, parallel positioning is not critical to the preferred embodiment of the present invention and it is contemplated for elongated side frame members 12 to also have arcuate structure for use in collecting objects from around a curved surface, such as that of a pole or a column. In the preferred embodiment of the present invention it is contemplated for sheet 14 to have uniform openings therethrough of a fixed mesh size. Although device 10 may be used individually, in the preferred embodiment it is also contemplated to have a variety of collection, inspection, sorting, funneling, and transfer devices 10, each with a different size of openings therethrough. FIG. 1 also shows sheet 14 having an unbounded bottom edge 28 and a top frame member 16 positioned between elongated side frame members 12 and attached to the top edge of sheet 14. Although not suitable for all uses of device 10, it is contemplated for the proximal ends of top frame member 16 and side frame members 12 to meet one another at a 45° angle but remain unconnected for ease in flexing sheet 14. In addition, a hooking member 20 is centrally attached to the outside portion of top frame member 16 for support of the present invention during periods of non-use. Hooking member 20 can also be used to empty objects from the surface of large sheets 14 by providing a means by which top frame member 16 can be raised mechanically. As top frame member 16 is raised, objects (not shown) on the surface of sheet 14 will move toward unbounded bottom edge 28 and off of sheet 14. The thickness of sheet 14 and the cross-sectional configuration and dimension of elongated side frame members 12 are not critical to the present invention although it is contemplated for elongated side frame members 12 and top frame member 16 to provide a raised edge around the perimeter of sheet 14 so that small objects (not shown) placed upon sheet 14 will not move across the top and side edges of sheet 14 during their sorting and inspection. Further, a hinge 22 can positioned between each elongated side frame member 12 and one end of top frame member 16 and connected thereto for providing additional stability to the present invention when it is used for sorting and transfer of heavier objects. However, in the preferred embodiment the use of hinge 22 is not critical to the present invention. In the preferred embodiment of the present invention the length of elongated side frame members 12, top frame member 16, and area dimension and configuration of sheet 14 are not critical as it is equally contemplated for the present invention to have a smaller dimension for hand-held use, as it is for the present invention to have a larger dimension for a variety of industrial applications. Also not critical to the present invention are the materials from which elongated side frame members 12, top frame member 16, and sheet 14 are made. In many applications it is preferred for elongated side frame members 12, top frame member 16, and sheet 14 to be made as a one-piece plastic unit through molded construction. For other applications, it is contemplated for sheet 14 to be made from materials having magnetic properties. However, it is contemplated for the materials from which elongated side frame members 12, top frame member 16, and sheet 14 are made to be light in weight, durable, and easily cleaned.

Figure 2:
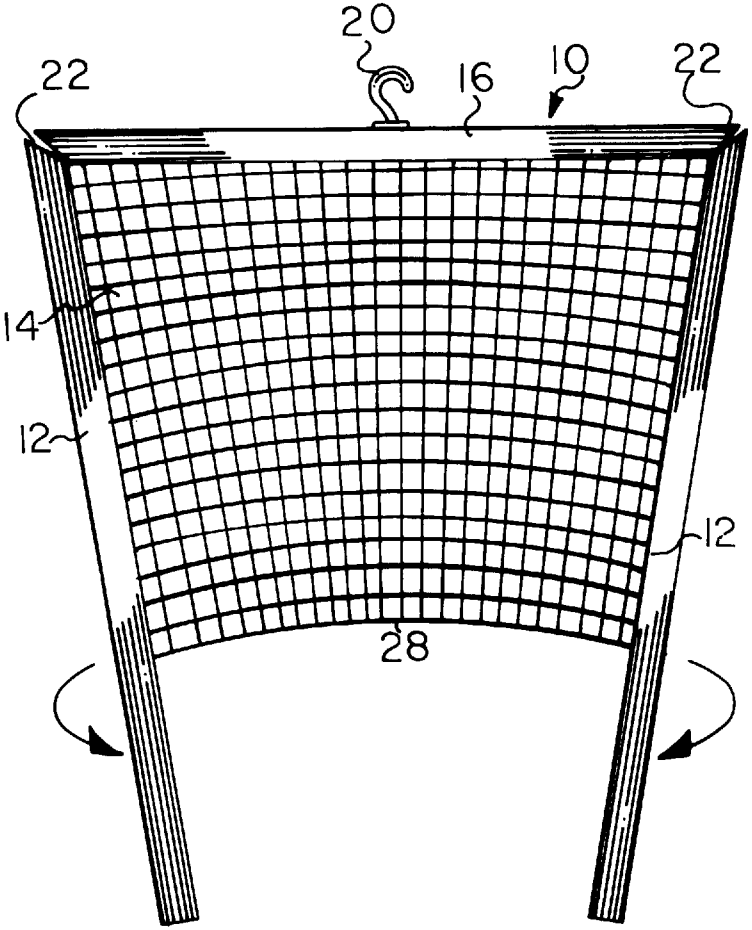
FIG. 2 is a perspective view of the invention having its side frame members moved forward toward one another so that its sheet is partially folded for use in transporting small objects and funneling them into storage containers.

FIG. 2 shows collection, inspection, sorting, funneling, and transfer device 10 having each side of its sheet 14 connected to one elongated side frame member 12, with top frame member 16 positioned between two spaced-apart elongated side frame members 12 and attached to the top edge of sheet 14. Although top frame member 16 is not contiguous with elongated side frame members 12, and for smaller hand tool embodiments frame member 16 remains unattached to elongated side frame members 12, in larger embodiments of the present invention, hinges 22 can be attached between the proximal ends of each elongated side frame member 12 and the end of top frame member 16 closest thereto. FIG. 2 also shows hooking member 20 centrally attached to outside portion of top frame member 16 for use in supporting the present invention in a vertical position during periods of non-use. Hooking member 20 can also be used to empty objects from the surface of sheet 14 by providing a means by which top frame member 16 can be raised mechanically to cause objects on sheet 14 to move toward and beyond unbounded bottom edge 26. In addition, FIG. 2 also shows each elongated side frame member 12 extending beyond unbounded bottom edge 28 for use as a handle, and each elongated side frame member 12 being moved forwardly toward the other so as to partially enfold small objects (not shown) against the surface of sheet 14 for use in transporting and funneling them into storage containers (not shown).

Figure 3:
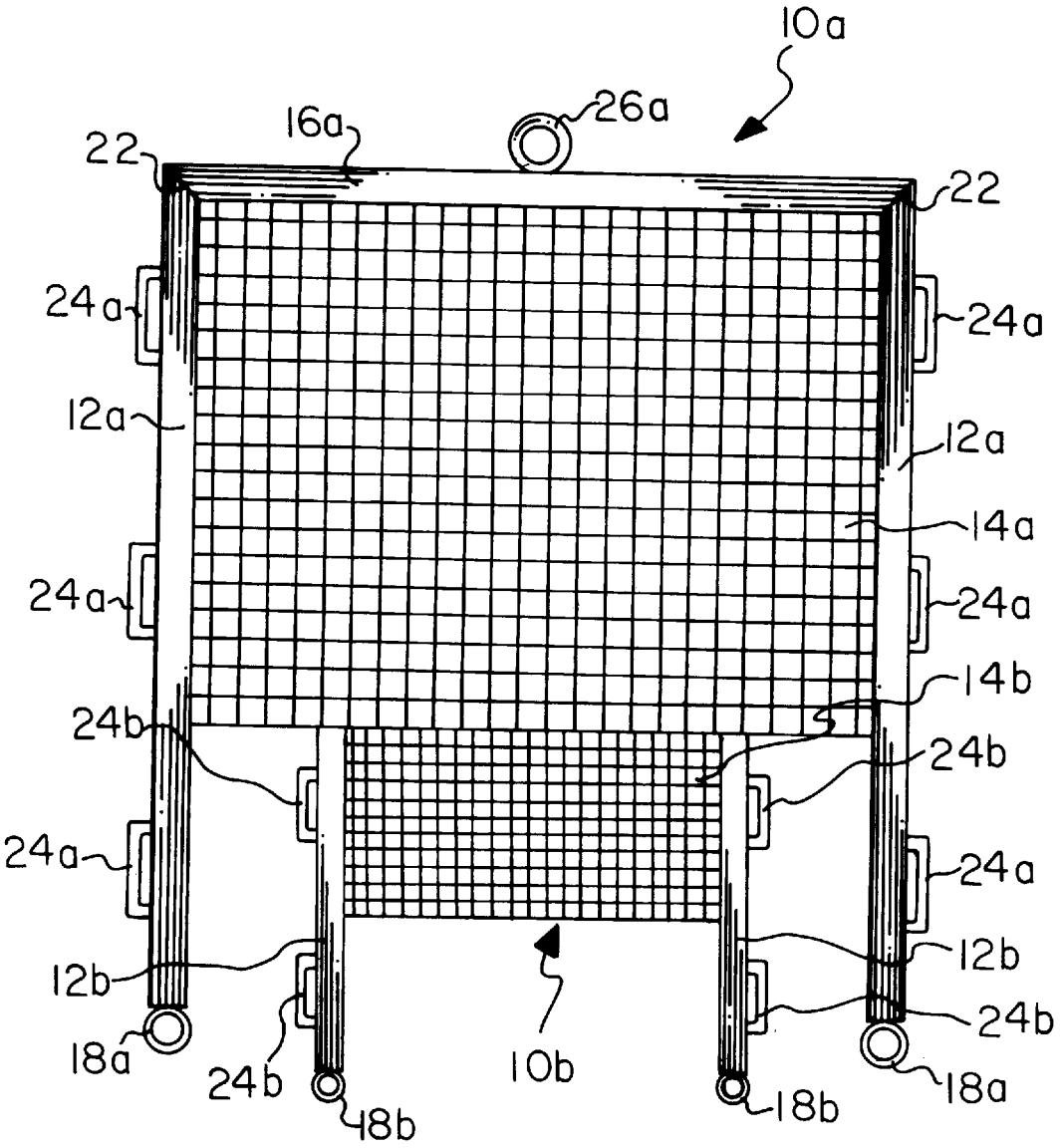
FIG. 3 is a top view of a first invention device being collectively used above a second invention device having smaller diameter openings therethrough for sorting small objects by size prior to the individual use of each device in transporting the small objects positioned upon the sheet of each device to another location or funneling them into storage containers.

FIG. 3 shows an upper collection, inspection, sorting, funneling, and transfer device 10*a* and a lower collection, inspection, sorting, funneling, and transfer device 10*b* being used collectively for the sorting of small objects (not shown) by size. Upper device 10*a* and lower device 10*b* can also each be used for the display of objects for inspection purposes. Lower device 10*b* has openings therethrough smaller in diameter than the openings through upper device 10*a*. FIG. 3 shows upper device 10*a* having sheet 14*a* connected between elongated side frame members 12*a*, top frame member 16*a* positioned between elongated side frame members 12*a* and attached to the top edge of sheet 14*a*, a closed loop 26*a* centrally attached to the outside portion of top frame member 16*a*, and a ring 18*a* connected to the distal end of each elongated side frame member 12*a*. The top frame member 16*a* remains detached from the proximal ends of elongated side frame members 12*a*. Lower device 10*b* comprises sheet 14*b* connected between elongated side frame members 12*b*, with a ring 18*b* connected to the distal end of each elongated side frame member 12*b*. Rings 18*a*, rings 18*b*, closed loop 26*a*, and a similar loop positioned on the top frame member of lower collection, inspection, sorting, funneling, and transfer device 10*b*, but not shown, would all be used for lifting upper device 10*a* and lower device 10*b* for transport of objects (not shown) positioned on the upper surfaces of sheets 14*a* and 14*b* and for successively raising top frame member 16*a* and the top support (not shown) of lower device 10*b* to cause objects (not shown) on the surface of sheets 14*a* and 14*b* to move over the unbounded edges of sheets 14*a* and 14*b*, respectively, to empty them. FIG. 3 further shows a plurality of support handles 24 connected to the outside surface of each elongated side frame member 12 for use in lifting devices 10a and 10b during some applications involving larger embodiments of the present invention. It is contemplated for support handles 24*a* and 24*b* to be structural members of side frame members 12*a* and 12*b*, respectively, and to be made from materials having density, composition, and form suitable to the intended use. Neither the configuration of support handles 24, nor the number of support handles 24 used, is critical to the present invention and would be dictated by its intended use. Although FIG. 3 shows sheet 14*a* and sheet 14*b* each having a rectangular shape, the configurations of sheet 14*a* and sheet 14*b* are also not critical to the present invention. Therefore it is also contemplated for sheet 14*a* and sheet 14*b* to have arcuate edges for use adjacent to curved surfaces, such as a pole or column (not shown).

Although not shown and not critical to the present invention, it is contemplated in the preferred embodiment for elongated side frame members 12 to have either circular, rectangular, or I-shaped cross-sectional configurations. Also not critical to the present invention are the number and type of hinges 22, hooking members 20, and closed loops 26*a* used. Further, it is also contemplated for the present invention to have other connection means for use, in place of rings 18, for attaching ropes, pulleys, and cables thereto for lifting and transporting larger embodiments of the present invention.

Figure 5:
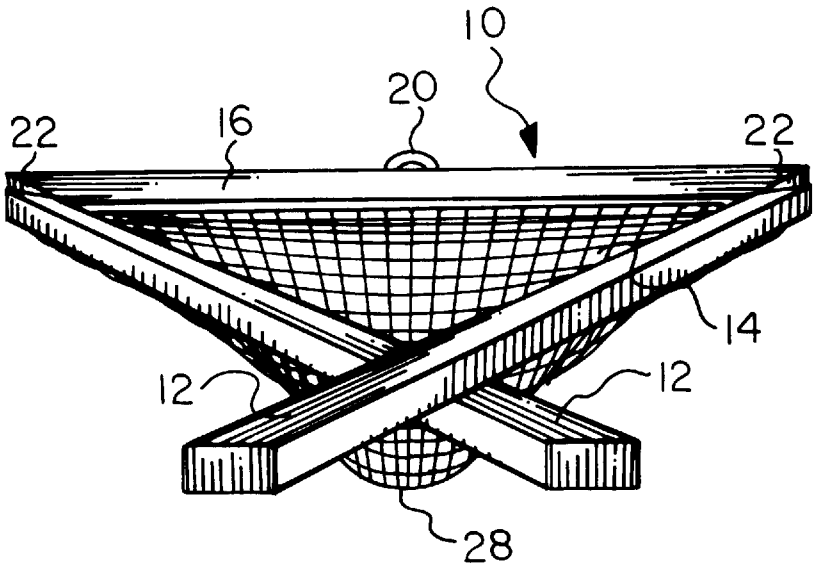
FIG. 5 is a perspective view of the invention with its handles folded across one another for use in maintaining an object against its sheet member.
Figure 4:
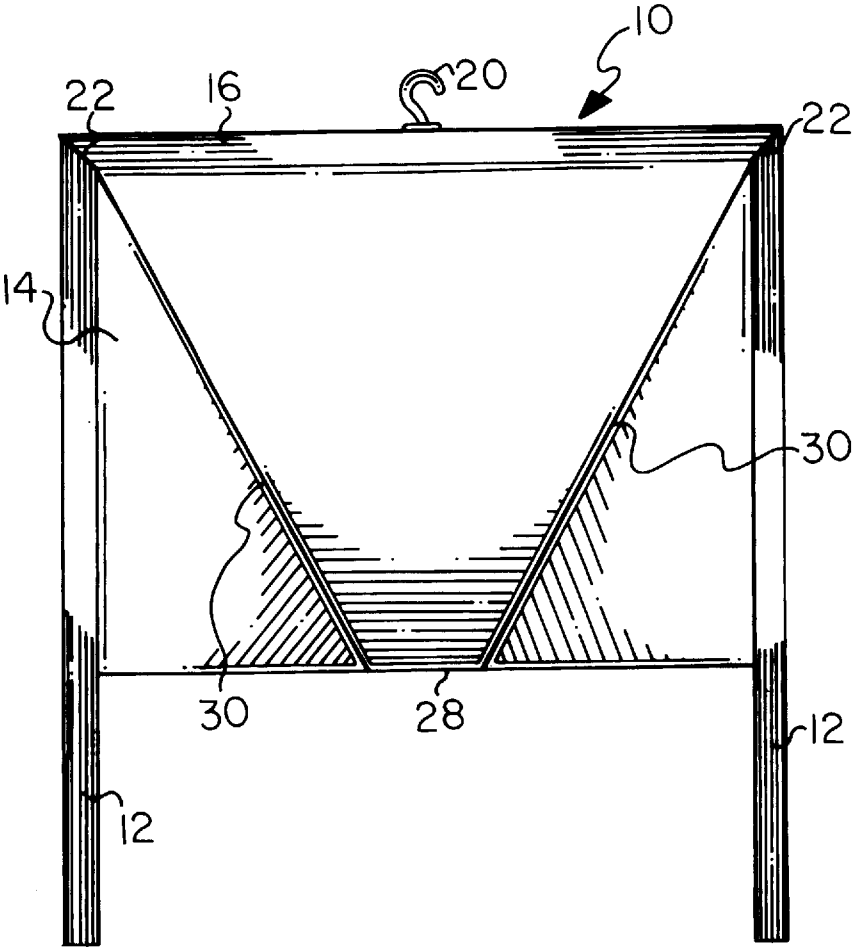
FIG. 4 is a top view of a second embodiment of the invention device having hinged or folded lines therein to aid its funneling function.

FIG. 4 shows a second embodiment of the present invention having sheet 14 with two fold lines 30 to aid in channeling the movement of objects across the surface of sheet 14. It is contemplated for the number of fold lines 30 to vary, but for a hinge to support fold lines 30 extending in positions other than the upper corners of sheet 14, the corresponding hinge being positioned in the adjacent portion of top frame member 16 or side frame member 12. In the embodiment shown in FIG. 4, it is contemplated for sheet 14 to have no openings therethrough. The manner in which fold lines 30 are made is not critical to the present invention. It is equally contemplated for sheet 14 to be made of plastic and for fold lines 30 to be pre-formed into the plastic material as it is for sheet 14 to be made from other materials, such as a thick aluminum foil, and for fold lines 30 to be hinged or creased into the metal. FIG. 4 shows two fold line 30 extending between the mid-portion of unbounded bottom edge 28 and the intersection of top frame member 16 and side frame members 12. FIG. 5 shows the handle portions of side frame members 12 folded across one another for use in maintaining objects against sheet 14 during transport, such as when collection, inspection, sorting, funneling, and transfer device 10 is used for such functions as catching and holding a ball (not shown) for subsequent tossing.

To use collection, inspection, sorting, funneling, and transfer device 10 it is contemplated for one or more such devices 10 to be positioned in a stacked flat configuration upon a substantially level surface (not shown) even though such substantially level surface may be the top of a cluttered work bench. Devices 10 having sheets 14 with a smaller mesh size would be successively placed beneath devices 10 having sheets 14 with larger mesh sizes. After small objects (not shown) have been collected on the surface of sheet 14 on the uppermost device 10, the uppermost device 10 would be lifted away from the other devices 10 positioned beneath it, the distal ends of the elongated side frame members 16 of the uppermost device 10 would be moved toward one another to partially fold sheet 14 around the collected small objects to contain them during transport to another location or transfer to a storage container (not shown), whereafter the top edge of sheet 14 would be raised for fast and orderly movement of the collected small objects over unbounded bottom edge 28 and into a storage container (not shown). Devices 10 could be used for handling and sorting small hardware objects such as screws, nuts, and washers; handling and sorting craft supplies such as beads, sequins, and shells; handling and sorting sewing supplies such as buttons, snaps, and hooks; and in the assembly of construction or repair kits having an assortment of small items. Also, in mail order houses, the present invention could be used to collect small items to fulfill orders, or by pharmacists to sort and package pills and medications. A separate present invention device 10 could be assigned to each bin containing small items and used to pick them up and place the needed number of small items into a package for distribution and sale, or for use by industrial robots using X,Y coordinate perspective for retrieving objects from bins. Also, present invention devices 10 could pick up and align long cylindrical objects for transport, and could be used to transport large elongated cylindrical objects such as dolphins to move them from one body of water to another. If sheet 14 were made from material that could be magnetized, device 10 could be used to separate a mixture of metallic and non-metallic objects. The distal ends of elongated side frame members 12 could also be moved toward one another to partially fold sheet 14 for use of device 10 in holding automobile and other parts while dipping them into cleaning solutions, collecting chopped foods and transferring them into a cooking pot, and catching balls tossed by a playmate. Sorting applications of device 10 could also include sifting sand on a beach to retrieve small shells and shark's teeth mixed therewith and for use in archaeology sites to sift dirt for the retrieval of bones and small pottery fragments mixed therein. One or more larger embodiments of device 10 could be placed in a stacked arrangement adjacent to, or under, machinery (not shown) for use in industrial applications such as the easy removal and sorting of small components used with the machinery and dropped during its operation or removal and sorting of salvageable scraps produced thereby. After a sufficient number of small objects are collected, the stacked devices 10 would be lifted one at a time mechanically by ropes, cables, and pulleys for transfer of the collected small components or scraps to storage containers. A plurality of support handles 24 on each elongated side frame member 12 could assist lifting larger present invention devices mechanically or by hand. Hooking members 20, closed loops 26, and rings 18 also aid in mechanical lifting of the invention devices 10. Further, the pattern of openings on sheet 14 could provide an X,Y coordinate grid for identification by industrial robots of position references to enable the robot to easily pick up objects (not shown) from bins into which the present invention is placed. Also since side frame members 12 support sheet 14, as well as function to prevent objects on the surface of sheet 14 from moving beyond the top and side edges of sheet 14, it is contemplated for side frame members 12 in different embodiments of the present invention to vary in configuration and dimension according to the intended purpose, sometimes necessitating side frame members 12 to be wider or higher than would otherwise be used for a different

What is claimed is:

1. A device for handling small objects which at a minimum can be used to perform the functions of collecting, inspection, sorting, transport, and efficient, funneling of said small objects into storage containers, said device comprising a planar sheet of material having a top edge, a bottom edge, and two side edges; and a three-sided frame connected to said top edge and said side edges of said sheet, said three-sided frame comprising a top frame member having opposite ends and two side frame members each having a distal end and a proximal end, said top frame member being connected to said top edge of said sheet and said side frame members each being connected to one of said side edges of said sheet, said proximal ends of said side frame members each remaining adjacent to, but unattached from, said opposite ends of said top frame member, and said distal ends of said side frame members each extending beyond said bottom edge of said sheet to form a handle, said handles each being movable toward one another to change said sheet from a flat configuration into various folded configurations in which said sheet can be wrapped around said small objects for secure transport of said small objects from one location to another, and whereby elevating said top frame member relative to said bottom edge of said sheet will initiate gravity-induced transfer of said small objects across said bottom edge of said sheet when said sheet is in both said flat and said folded configurations.

2. The device of claim 1 wherein said sheet, said elongated side frame members, and said top frame member are made from plastic material and molded construction so as to be a one-piece unit.

3. The device of claim 1 wherein said sheet is made from flexible material.

4. The device of claim 1 wherein said bottom edge of said sheet has a central portion and said sheet has a plurality of fold lines therein, each of said fold lines being configured to aid in said funneling function and having one end positioned within said central portion.

5. The device of claim 1 wherein said elongated side frame members, said sheet, and said top frame member are made from materials inert to cleaning solutions so that said device can be used to hold small objects during cleaning procedures.

6. The device of claim 1 wherein said sheet is made from materials that can be magnetized so that said sheet can be used to quickly sort a mixture of magnetic and non-magnetic small objects.

7. The device of claim 1 wherein said elongated side frame members and said top frame member are each selected from a group consisting of frame members having round cross-sectional configurations and frame members having I-shaped cross-sectional configurations.

8. The device of claim 1 wherein said sheet has a plurality of uniformly sized openings therethrough, said openings being of sufficient dimension so that two of said devices each having openings of a different size can be used collectively to sort said small objects by size.

9. The device of claim 1 further comprising hinging means connected between each of said opposite ends of said top frame member and said proximal end of one of said elongated side frame members.

10. The device of claim 1 wherein said device further comprises said opposite ends of said top frame member each abutting one of said proximal ends of said elongated side frame members at an approximate 45° angle.

11. The device of claim 1 further comprising connection means attached to said distal ends of each of said elongated side frame members and attached centrally to said top frame member, said connection means being configured and dimensioned to aid in mechanical movement and elevation of larger ones of said devices for transfer of small objects positioned on said sheet from one location to another and also across said bottom edge of said sheet and into a storage container.

12. The device of claim 11 further comprising a plurality of support handles connected to each of said elongated side frame members in positions on said elongated side frame members opposed to said sheet.

13. The device of claim 1 wherein said sheet has a rectangular configuration and said side frame members are approximately parallel when said sheet is in said flat configuration for sorting and inspection of objects placed on top of said sheet.

14. The device of claim 1 wherein said sheet has arcuate edges and said side frame members have correspondingly arcuate configurations for placement of said sheet around an object having a curved surface.

15. The device of claim 11 wherein said connection means is selected from a group consisting of a plurality of rings and a plurality of closed loops.

16. A method for handling small objects which includes the functions of collecting, inspecting, sorting, transferring, and funneling said small objects to a storage container, said method comprising the steps of providing a pair of elongated side frame members, a top frame member, and a planar sheet of material;

attaching each of said elongated side frame members to opposite sides of said sheet so as to leave an unattached portion of each elongated side frame member for use as a handle;

attaching said top frame member to the top of said sheet so that opposite ends of said top frame member each abut one end of one of said elongated side frame members at an approximate 45° angle and at the same time remain unattached thereto and so that said top frame member and said elongated side frame members together form a three-sided frame and leave one unbounded bottom edge on said sheet;

positioning said three-sided frame where small objects can become placed upon the upper surface of said sheet;

moving the portions of said elongated side frame members forming a handle toward one another to partially fold said sheet and enclose said small objects against said sheet;

using said device in a partially folded configuration to transport small objects to a storage container;

raising said top) frame member above said handles and over said storage container to transfer small objects across said unbounded bottom edge of said sheet and into said storage container, and collectively using at least two of said three-sided frame and sheet combinations to sort said small objects by size.

17. The method of claim 16 further comprising the step of providing a plurality of hinges; and attaching at least one of said hinges between said top frame member and each of said elongated side frame members.

18. The method of claim 16 further comprising the steps of providing a plurality of rings, a plurality of closed loops, and a plurality of support handles; attaching a selection of said rings, said closed loops, and said support handles to said side frame members and said top frame member; and using said rings, said closed loops, and said support handles attached to said top frame member and to said side frame members for mechanically lifting said sheet.

* * * * *